United States Patent [19]

Kim

[11] Patent Number: 4,694,524

[45] Date of Patent: Sep. 22, 1987

[54] CLAMPING HEAD FOR REPLACEABLE STRING MOP

[76] Inventor: Kwan C. Kim, P.O. Box 48 (133 Mauna Kea St.), Hilo, Hi. 96721

[21] Appl. No.: 854,659

[22] Filed: Apr. 17, 1986

Related U.S. Application Data

[63] Continuation-in-part of Ser. No. 696,442, Jan. 30, 1985, abandoned.

[51] Int. Cl.[4] ..... A47L 13/258

[52] U.S. Cl. ..... 15/150; 15/105; 15/229 A

[58] Field of Search ..... 15/147 R, 147 B, 147 C, 15/149-153, 228, 229 A, 229 B

[56] References Cited

U.S. PATENT DOCUMENTS

| | | | |
|---|---|---|---|
| 2,368,037 | 1/1945 | Osborne et al. | 15/151 |
| 2,501,514 | 3/1950 | Hill | 15/150 |
| 3,328,822 | 7/1967 | Sellesi | 15/151 |
| 4,015,305 | 4/1977 | Komatsu | 15/150 |
| 4,422,203 | 12/1983 | Zenker | 15/150 |

*Primary Examiner*—Edward L. Roberts

*Attorney, Agent, or Firm*—William B. Walter

[57] ABSTRACT

A replaceable string mop element is clamped between the mating toothed jaws of a selectively openable clamp which when clamped to the mop may be inserted into a longitudinal T-slot socket in a base fixed to the mop handle and selectively locked therein by a suitable catch.

3 Claims, 16 Drawing Figures

CLAMPING HEAD FOR REPLACEABLE STRING MOP

This is a continuation-in-part of U.S. Application Ser. No. 696,442 filed Jan. 30. 1985, now abandoned, of Kwan Chi Kim.

TECHNICAL FIELD OF THE INVENTION

This invention is in the field of floor mops and particularly those mops having replaceable string mop elements.

DESCRIPTION OF THE RELATED ART

Shown incidentally in patents covering attachments for scrapers, brushes and abrasive pads to string mop and clamp assemblies are basically the following types of clamping heads:

a. screw jack clamp; Kim U.S. Pat. No. 4,306,326;

b. toggle clamp; De Vore U.S. Pat. No. Des. 163,585;

c. compression spring clamp; Wilson U.S. Pat. No. 701,657;

d. toggle and spring clamp, Held U.S. Pat. Nos. 732,743 and 732,744; McLaughlin 937,007; Newman 2,683,886; Dryden 3,167,798; Paul 2,133,148;

e. torsion spring clamp, Brosseau U.S. Pat. No. 444,043.

In each of these units, the user must install and remove the string mop element from or into the clamping head while holding the head on the end of the mop handle, the mop handle normally placing the head in an awkward position, because of the length of the handle. This is particularly undesirable when the user is removing a wet and often dirty string mop element.

BRIEF SUMMARY OF THE INVENTION

The mop clamping system of this invention is a parallel jaw clamp which is separable from the mop handle thus facilitating the installation and replacement of string mop elements. The two jaws of the parallel jaw clamp are flexibly joined at one end and openable at the other end to allow insertion and removal of a string mop element. A quick release fastener at the open end of the parallel jaws is used to close the jaws at that point and allow a gripping force to be applied by drawing the jaws together tightly on the string mop element. The longitudinal edges of the upper jaw of this clamp are inserted into a T-slot shaped socket in the bottom of a mop base attached to the mop handle for ease of removal from and attachment of the clamped mop element to the mop handle. A spring catch anchors the clamped mop element in the T-slot shaped socket.

DETAILED DESCRIPTION OF THE INVENTION

Figure 2:
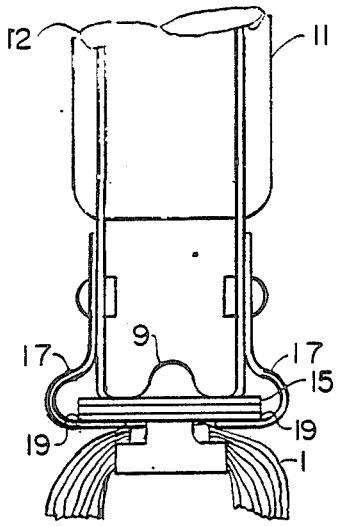
FIG. 2 is an enlarged left hand elevation of the mop assembly as shown in FIG. 1. Enlarging of this view is to clarify the details of the construction
Figure 1:
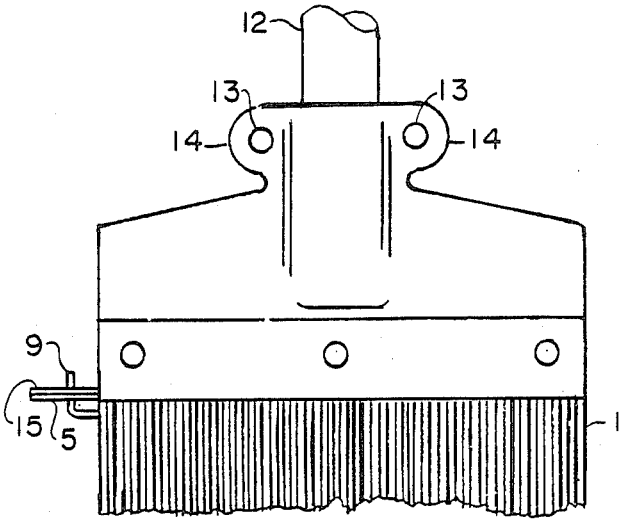
FIG. 1 is a front elevation of the string mop heading according to my invention with the string mop element clamped in the parallel jaw assembly which is fully inserted and locked in place in the mop head at the base of the mop handle.
Figure 3:
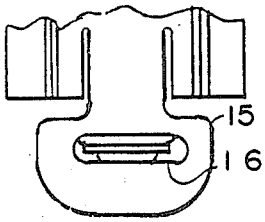
FIG. 3 is a plan view of the left hand end of the mop assembly of FIGS. 1 and 2. This is an enlarged view as in FIG. 2 for clarity.
Figure 4:
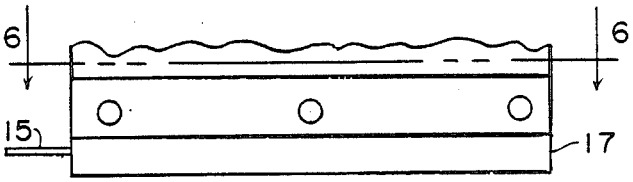
FIG. 4 is a front elevation of the mop head of FIGS. 1 and 2 with the parallel jaw assembly removed therefrom.
Figure 5:
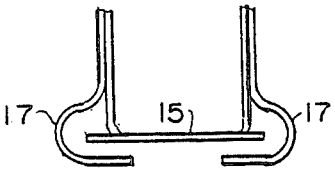
FIG. 5 is a left hand elevation of the mop head as seen in FIG. 4 with the jaw assembly removed therefrom and enlarged as in FIGS. 2 and 3 for clarity.
Figure 6:
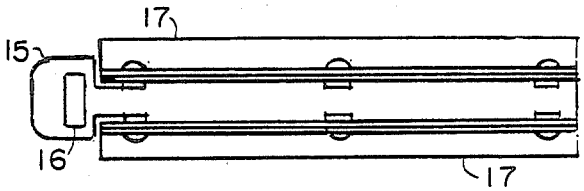
FIG. 6 is a sectional view on the line 6—6 of FIG. 4.

A conventional string mop element 1 such as the Royal Maid Cottom Mop made be Royal Maid Association for the Blind, Inc., Post Office Drawer 30, Hansen Road, Hazelhurst, Missippi, 39083 consists of a multitude of cotton strings, each of which is about 26 inches long bound together midway of their lengths by a narrow cotton tape as a belt with sewed seams through the belt and the 26 inch long strings. The string mop element 1 is about 5 inches wide at the belt and when the string mop element 1 is held in the clamp 2, the loose strings hang down about 12 inches.

In the preferred embodiment of my invention, the clamp 3 is a parallel jaw clamp made from 24 gage galvanized sheet steel approximately 1¼ inches by 13 inches, bent midway of its length at 4 to form a U-shaped spring. Both the upper jaw 5 and the lower jaw 6 have dimpled holes 7 along their lengths to serve as teeth to prevent the clamped portion of the string mop element from sliding to one side or the other when clamped, thus preventing bunching of the mop element 1. The teeth 7 of the upper and lower jaws face each other as shown. A bayonet slot 8 in the upper jaw 5 co-operates with an upstanding barbed tongue 9 formed in the free end of the lower jaw 6 of the clamp 3 to selectively hold the clamp 3 closed. It will be noted that this clamp lock comprised of the bayonet slot 8 and tongue 9 end of the clamp 3 being free of the mop-clamping portion is a handle for removing the clamped mop assembly without requiring the user to touch the dirty mop 1.

Figure 9:
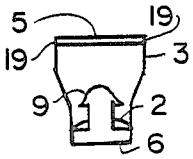
FIG. 9 is a left hand elevation of the parallel jaw clamp as seen in FIGS. 7 and 8.

In the preferred embodiment of my invention the lower jaw 6 of the clamp 3 is formed with a rounded longitudinal ridge 2 as seen in FIG. 9 for stiffness along its length from near the barbed tongue 9 to near the bend 10. The upper jaw 5 of the clamp 3 is wider than the lower jaw 6 as seen in FIG. 9 so as to provide flanges 19 to engage a longitudinal T-slot socket member formed by the facing channels 17 in the mop head 11 as seen in FIG. 2. As in FIGS. 1, 2, 4, 5, 10, 11 and 12 this longitudinal T-slot socket member is disposed transverse to the mop handle and attached to the mop base 11. The flanges 19 of the upper jaw 5 of clamp 3 and the clamped mop 1 thus form a T-section which is a longitudinal T-slot engaging member.

Secured to the mop handle 12 is the mop head or base 11 formed from 24 gage galvanized steel sheet into a U-shape. The upper portion of the head 11 is formed into a socket for the mop handle 12 and is clamped thereto by rivets 13 through ears 14. The bottom of the U has a spring tongue 15 with a slot 16. Attached to the sides of the head 11 are curved angle members to provide receiving channels 17 forming a longitudinal T-slot socket member for the edges 19 of the upper jaw 5 of the clamp 3 as seen in FIG. 2 and noted above.

Figure 7:
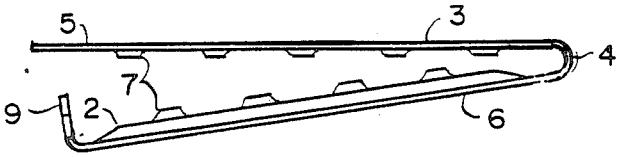
FIG. 7 is a front elevation of the parallel jaw clamp in its open position with the string mop element removed therefrom.
Figure 8:
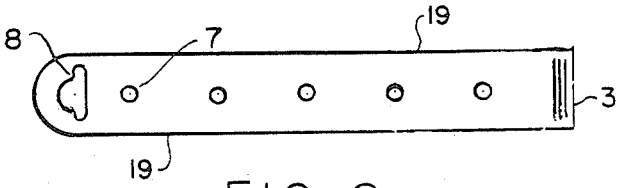
FIG. 8 is a plan view of the parallel jaw clamp as seen in FIG. 7.
Figure 10:
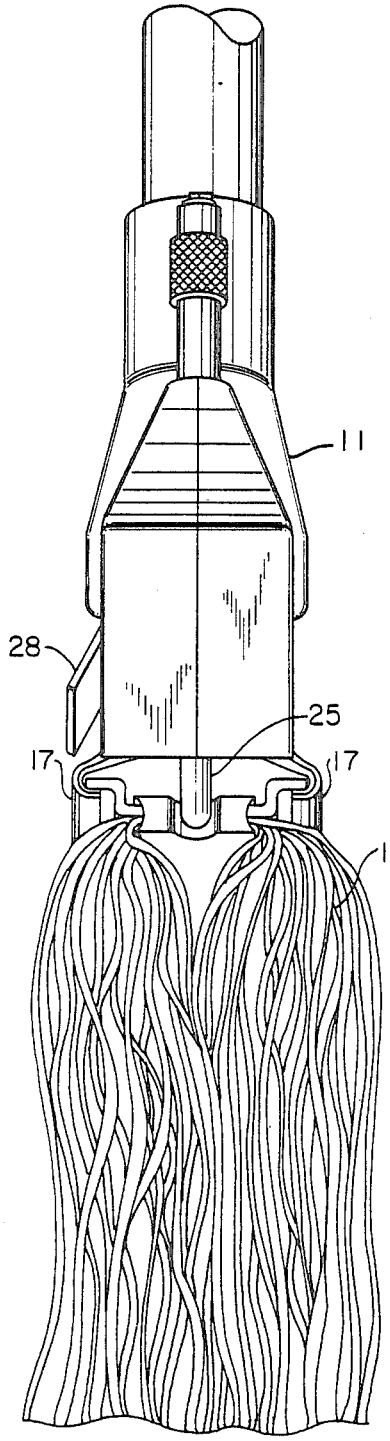
FIG. 10 is a side elevation of another embodiment of the mop holder of this invention showing the holder somewhat tilted and including the mop.

Installation of the mop element 1 into the mop head 11 is as follows:

1. With the clamp 3 separated from the head and open as seen in FIG. 7, the bound central portion of the mop element 1 is slipped into the clamp 3 between the upper and lower jaws 5 and 6.
2. The clamp jaws 5 and 6 are pressed together sinking the teeth 7 into the string mop element 1 and the barbed tongue bent to enter the wide portion of the bayonet slot 19 then allowing the barbed tongue 9 to spring into the narrow portion of the bayonet slot 19 with the barbs above the upper jaw 6 thus locking the clamp 3 about the string mop element 1 forming with the mop element 1 a clamped mop assembly.
3. The clamp 3 holding the string mop element 1 is slid into the socket formed by angles 17 in the mop head 11 as seen in FIG. 2 until the barbed tongue 9 enters the slot 16 of the spring tongue 15 locking the clamp 3 in the head 11. When the mop 1 is worn out, it can be readily removed with the clamp 3 as a clamped mop assembly by releasing the spring catch 15, grasping the bayonet slot end of the clamp 3 and pulling the clamped mop assembly free of the mop base 11. The worn out mop 1 may then be discarded as a clamped mop assembly without handling the dirty mop itself.

In this preferred embodiment shown and described herein, the longitudinal socket member is integral with the mop head 11. It is recognized that an equivalent structure could comprise a multitude of varieties of quick release fastening means including having the T-section integral with the mop head 11 and the longitudinal T-slot formed in the clamp 3.

Figure 11:
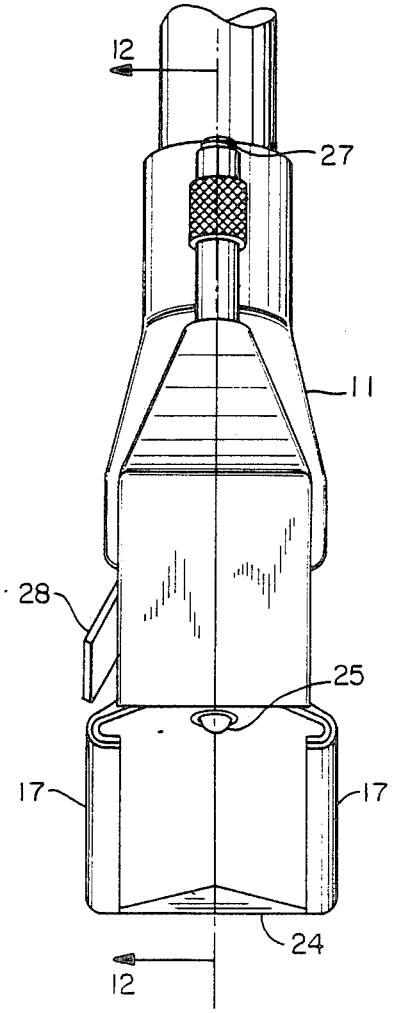
FIG. 11 is a side elevation, tilted as in FIG. 10, of the mop holder of FIG. 10 with the mop assembly removed.
Figure 12:
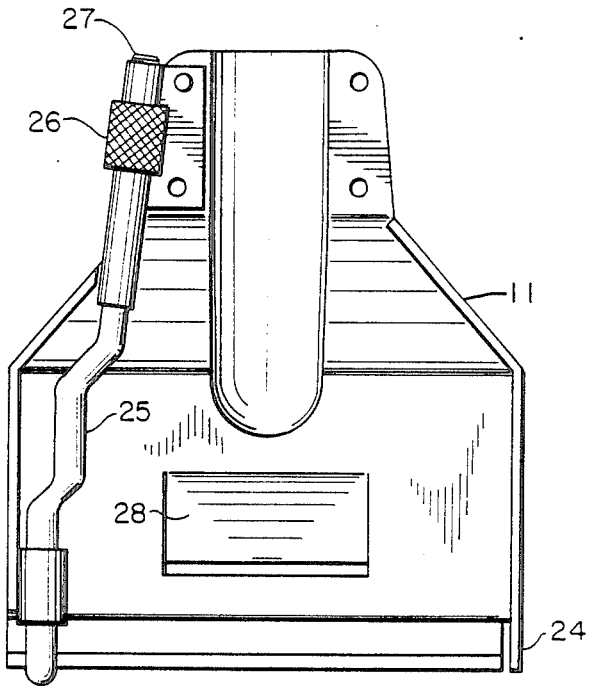
FIG. 12 is a sectional view of the mop holder of FIGS. 10 and 11 on the line 12—12 of FIG. 11.
Figure 13:
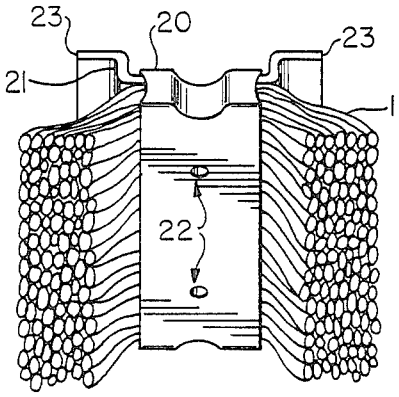
FIG. 13 is a perspective view of the mop assembly of FIG. 10, tilted as in FIG. 10, with the mop elements partially cut off in length and removed from the mop holder.
Figure 14:
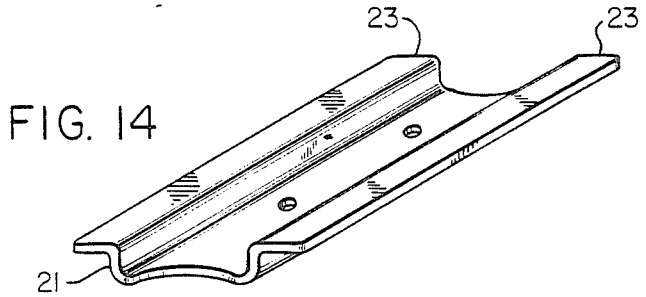
FIG. 14 is a perspective of the channel member of the mop assembly of FIG. 13.
Figure 15:
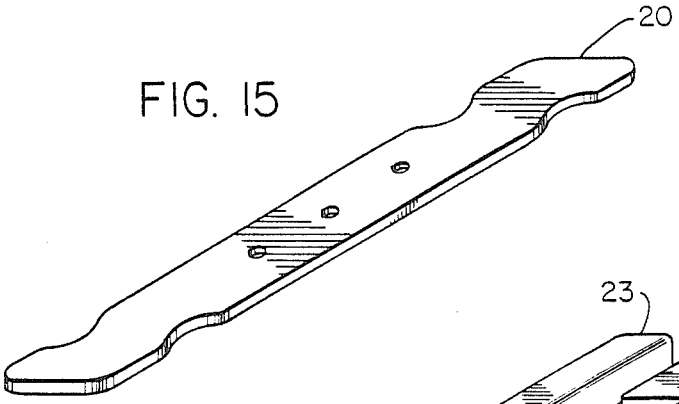
FIG. 15 is a perspective of the strap member of the mop assembly of FIG. 13.
Figure 16:
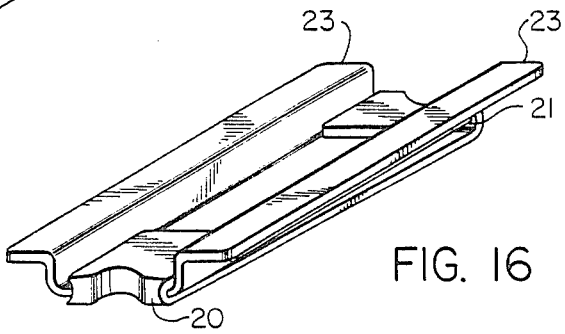
FIG. 16 is a perspective view of the strap member of FIG. 15 clamped to the channel member of FIG. 14 for clarity without the mop member shown.

In another embodiment of the mop holder of this invention as shown in FIGS. 10–16 the mop member 1 is clamped between a strap member 20 and a channel member 21. Rivets 22 through strap 20, mop 1 and channel 21 further secure these three elements as a mop assembly. Flanges 23 of the channel 21 can be engaged with channels 17 forming a longitudinal T-slot socket member disposed transverse to the mop handle. The mop assembly as shown in FIG. 13 is then slid into place against the back stop wall 24 of the mop holder as shown in FIGS. 11 and 12. A sliding bolt 25 is then extended across behind the end of the mop assembly by a knurled nut 26 acting in co-operation with screw threads 27 on the upper end of bolt 25.

The strap 20 may be formed into a trough shape at each end as it is clamped about the mop 1 and channel 21 so as to better interfit with the bolt 25. A scraper blade 28 is provided on one side of the sheet metal body of the mop holder for removing gum and other such extraneous materials from the floor being cleaned.

I claim:

1. A clamping head for replaceable string mop elements comprising:

a. a mop handle;

b. a mop base operably attached to one end of said mop handle;

c. a longitudinal T-slot socket member disposed transverse to the mop handle, said socket member operably attached to said mop base;

d. a clamped mop assembly comprised of a string mop, the strings of which are bound together midway of their lengths and a clamp means comprised of a pair of parallel, opposed clamping members the bound portion of said string mop being clamped between and by said parrallel opposed clamping members;

e. said clamp means defining a longitudinal T-slot engaging flange member selectively attached to said mop base member by engagement with said longitudinal T-slot socket member;

f. a catch operably attached to said mop base releasably locking said longitudinal T-slot engaging flange member in said longitudinal T-slot socket member whereby a worn out and dirty clamped mop assembly may be readily removed by hand from the socket in the mop base by first releasing said catch, holding onto the clamp with one hand and the mop handle of base with the other hand without touching the dirty mop, the old clamped mop assembly discarded, and a new clamped mop assembly inserted and locked into the mop base all without getting the hands dirty.

2. A clamping head for replaceable string mop elements as claimed in claim 1 wherein said catch is a spring catch.

3. A clamping head for replaceable string mop elements as claimed in claim 1 wherein said catch is a sliding bolt. .

* * * * *